United States Patent [19]

Campbell

[11] 4,339,232

[45] Jul. 13, 1982

[54] PRESSURE DIFFERENTIAL LIQUID TRANSFER SYSTEM

[76] Inventor: George T. R. Campbell, P.O. Box N 3033, Nassau, The Bahamas

[21] Appl. No.: 194,437

[22] Filed: Oct. 6, 1980

[51] Int. Cl.[3] ..... F04F 1/00

[52] U.S. Cl. ..... 417/54; 137/205; 417/148

[58] Field of Search ..... 137/205, 398, 144, 142; 417/148, 149, 138, 54

[56] References Cited

U.S. PATENT DOCUMENTS 1,694,421 12/1928 Lentz ..... 137/205 X
2,540,361 2/1951 Whitley ..... 137/398
2,815,765 12/1957 Adelson ..... 137/205
3,829,246 8/1974 Hancock ..... 417/148

*Primary Examiner*—Alan Cohan
*Attorney, Agent, or Firm*—Larson and Taylor

[57] ABSTRACT

A method for raising liquid from a reservoir to a tank positioned above the reservoir, the liquid being withdrawn from the tank at the same rate that it enters for further utilization. The method involves providing a pressure differential, in part by creating a sub-atmospheric pressure within the tank combined with pressure derived from a head of water above the water supply conduit pipe inlet, to cause the liquid to flow up a conduit connecting the tank and reservoir. The invention also relates to a system for carrying out the method.

1 Claim, 1 Drawing Figure

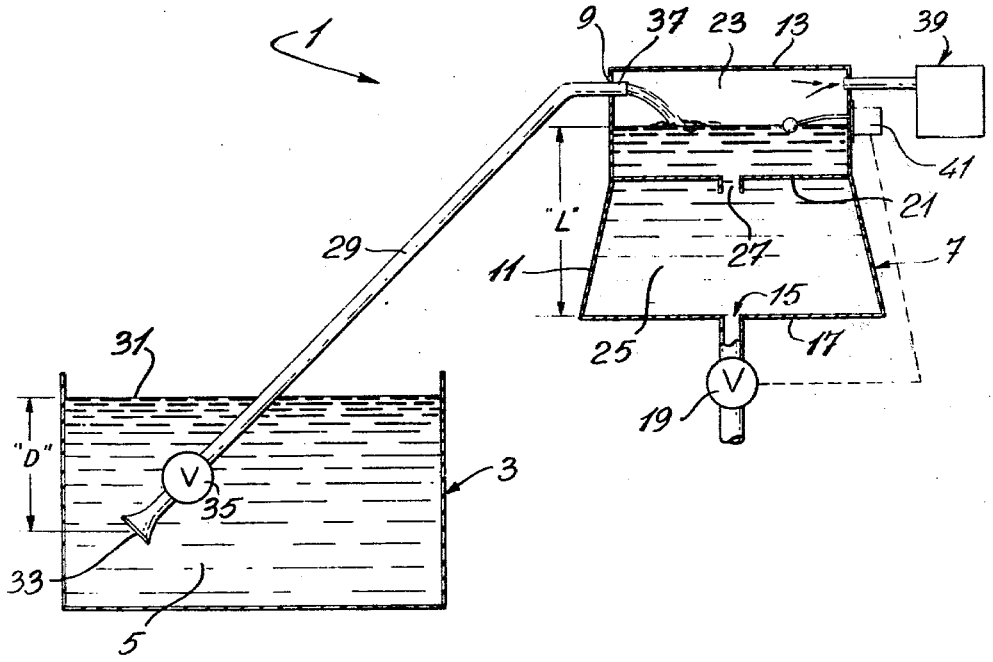
1
9
37
23
13
39
41
21
"L"
27
29
11
7
15
25
17
31
19
"D"
3
35
33
5

PRESSURE DIFFERENTIAL LIQUID TRANSFER SYSTEM

This invention is directed toward a novel method for handling liquid, and to a system for carrying out the method.

The invention is more particularly directed toward a novel method for raising liquid from a reservoir, and to a system for carrying out the method.

The invention is directed toward a novel manner for raising liquid from a liquid reservoir to a tank positioned above the reservoir. The liquid is raised by creating a pressure differential between the entrance of a conduit, positioned within the liquid in the reservoir, and the exit of the conduit located at the inlet of the tank. The pressure differential is created, in part, by providing a sub-atmospheric pressure at the conduit exit within the tank. Atmospheric pressure plus the head of water above the conduit entrance, less the sub-atmospheric pressure within the tank, provides the pressure differential for raising water through the conduit from the reservoir to the tank.

The liquid is withdrawn from the tank through an outlet at substantially the same rate that it enters the tank through the inlet without disturbing the sub-atmospheric pressure within the tank. The withdrawn liquid can be stored in another reservoir for raising it still higher in another stage employing a duplicate system. Alternatively the liquid can be returned to the first reservoir, its return being used to create power such as electrical power.

The system is designed so that a constant quantity of liquid is retained within the tank between its outlet and the inlet. The sub-atmospheric pressure is maintained in the tank above the liquid retained in the tank and the retained liquid seals the outlet from the sub-atmospheric pressure. Preferably baffle means are provided in the tank, within the retained liquid, to enhance the vacuum effect on the surface area of the retained liquid. The sub-atmospheric pressure in the tank above the retained liquid can be provided and maintained by a vacuum pump, or other suitable means.

The invention is particularly directed toward a method for raising liquid from a reservoir of liquid to a tank positioned above the reservoir. The tank has a liquid inlet in its top portion and a liquid outlet in its bottom portion with a conduit extending from the liquid inlet. The method comprises the steps of placing the entrance of the conduit within the reservoir at a desired depth and then filling the tank with a liquid to a desired level beneath the inlet. A sub-atmospheric pressure created within the tank above the liquid draws liquid into the tank through the conduit from the reservoir. When the conduit is placed into the reservoir the liquid rushes in to fill the conduit and discharge the liquid into the tank. This flow of liquid is maintained and the liquid is caused to flow in the conduit by the sub-atmospheric pressure in the tank. The flow of liquid out of the tank through the outlet is controlled to maintain the level of liquid within the tank at the desired level. Thus the flow in the system is maintained and the kinetic energy of the flowing liquid first caused by the liquid rushing in to fill the conduit as it is placed below the surface of the liquid in reservoir is maintained.

The invention is also directed toward a system for raising liquid from a reservoir of liquid, the system having a liquid receiving tank adapted to be positioned above the reservoir. The tank has a liquid inlet in its top portion and a liquid outlet in its bottom portion. Conduit means extend from the tank inlet and are adapted to be positioned within the liquid in the reservoir. Means are provided for maintaining a desired level of liquid within the tank beneath the inlet. Means are also provided for creating a sub-atmospheric pressure within the tank above the liquid.

The invention will now be described in detail having reference to the accompanying single drawing, showing a schematic view of the system.

The system 1 includes a reservoir 3 for holding a liquid 5. The reservoir can comprise a pond, a lake, a ship's hull or a large tank, as shown, by way of example. A liquid receiver is located above the reservoir 3, supported by suitable means (not shown). The receiver comprises a closed tank 7. A liquid inlet 9 is located in the side wall 11 of the tank 7, adjacent the top wall 13. A liquid outlet 15 is located in the bottom wall 17 of the tank. A valve 19 is provided in the outlet 15 for opening or closing the outlet 15. A baffle 21 is provided within the tank 7 dividing the interior of the tank into an upper portion 23 and a lower portion 25. An opening 27 in the baffle 21 connects the upper and lower tank portions 23, 25 together. The baffle 21 reduces the exposure of the liquid in the lower portion 25 to the sub-atmospheric pressure in the upper portion 23.

A conduit 29 is provided between the reservoir 3 and the raised tank 7. The conduit 29 extends at a suitable angle to the surface 31 of the liquid 5 in the reservoir and has its inlet end 33 located a desired distance "D" below the surface 31 of the liquid. A valve 35 is provided in the conduit 29 adjacent its inlet end 33. The outlet end 37 of the conduit 29 is located in the upper portion 23 of the tank 7, the conduit 29 passing through the tank inlet 9.

Means are provided for creating a sub-atmospheric pressure within the tank 7. These means can comprise, by way of example, a vacuum pump 39 connected to the upper portion 23 of the tank 7.

To operate the system, the tank 7 is filled with liquid to a desired level "L" with liquid completely filling the lower portion 25 of the tank 7 and part of the upper portion 23. The level of the liquid within the tank is below the inlet 9 however. The valve 35 in the conduit 29 is closed and the conduit is emptied of liquid. The vacuum pump 39 is then operated to provide a desired sub-atmospheric pressure within the upper portion 23 of the tank 7 and the conduit 29. The inlet valve 35 at the inlet end 33 of the conduit is then opened and liquid flows up the sloping conduit 29, from the reservoir, into the tank 7 due both to the pressure exerted by the liquid in the reservoir above the pipe inlet 33 and atmospheric pressure, and due to the sub-atmospheric pressure within the tank.

The liquid flowing into the upper portion 23 of the tank 7 through conduit 29 is withdrawn at substantially the same rate through tank outlet 15 in the bottom portion 25. The tank 7 is appropriately shaped, and has sufficient height, so as to provide sufficient pressure at the outlet 15 for withdrawal of the liquid from the tank against the sub-atmospheric pressure within the top portion of the tank. Preferably, a level sensor 41 is located in the upper portion 23 of the tank 7 and is connected to suitable means (not shown) which control the valve 19 in outlet 15 so as to maintain the liquid level "L" in the tank at the desired level.

The liquid withdrawn through outlet 15 can be returned to the reservoir 3. The energy in the returning liquid is utilized to produce power, such as electrical power for example. Alternatively, the system can be operated as a pumping system, to circulate cooling liquid for example.

The system is very suitable for use on ships, where the ocean provides the reservoir. The inlet of the conduit is located at the bottom of the ship to place it well beneath the surface of the lake or ocean so as to provide the necessary pressure head. The system can be used to produce electrical power and/or to circulate cooling liquid in the cooling system.

The reservoir should be large enough so as to limit the entrainment of air in the liquid therein, thereby improving the efficiency of the vacuum system. A large reservoir limits turbulence created at the conduit inlet thus minimizing air entrainment. The conduit is set at an angle relative to the surface 31 of the liquid in the reservoir 3 to obtain optimum flow velocity of the liquid through the conduit while minimizing friction losses. The conduit inlet is shaped to provide efficient entry of the liquid.

The baffle plate 21 reduces the vacuum effect on the liquid retained within the tank. In addition, the baffle plate 21 minimized turbulence in the liquid contained in the lower portion 25 of the tank 7. This liquid in the lower portion 25 serves to partially seal the tank outlet 15 from the sub-atmospheric pressure in the upper portion 23 of the tank. The baffle location is dictated by the flow capacity required by the system. If desired, the baffle can be adjustably mounted within the tank so that its position can be varied to obtain optimum results depending on the particular flow capacity required. In some systems, the baffle can be dispensed with. Once the system is in operation, liquid continuously flows up the conduit, into the tank, and out of the tank and the kinetic energy of the system can be advantageously employed. It follows that a series of systems could be used to raise the liquid to higher levels.

The embodiments of the invention in which an exclusive property or privilege is claimed are defined as follows:

1. A method of raising liquid from a reservoir of liquid to a tank positioned above the reservoir, the tank having a liquid inlet in its top portion and a liquid outlet in its bottom portion, and a conduit sloping down and away from the liquid inlet with closure means at the free end thereof; the method comprising the steps of: with the closure means closed, placing the free end of the conduit within the reservoir at a desired depth and if necessary emptying the conduit above the closed valve; filling the tank with liquid to a desired level beneath the inlet; creating a desired sub-atmospheric pressure within the tank above the liquid, and within the conduit above the closure means; opening the closure means to permit liquid in the reservoir to enter the conduit and to move into the tank as a result of the head of liquid at the free end of the conduit, the momentum of the liquid rushing into the sloping conduit when the closure means is opened, and the sub-atmospheric pressure in the conduit and tank; and controlling the flow of liquid out of the tank through the outlet to substantially maintain the level of liquid within the tank at the desired level.

* * * * *